United States Patent [19]

Maier et al.

[11] Patent Number: 4,828,464

[45] Date of Patent: May 9, 1989

[54] DIAPHRAGM PUMP DEVICE

[75] Inventors: Martin Maier, Ludwigsburg; Heinz Sayer, Erdmannshausen; Gerhard Gebauer, Bermatingen, all of Fed. Rep. of Germany

[73] Assignee: J. Wagner GmbH, Fed. Rep. of Germany

[21] Appl. No.: 161,177

[22] Filed: Feb. 26, 1988

[30] Foreign Application Priority Data

Feb. 27, 1987 [DE] Fed. Rep. of Germany ..... 3706338

[51] Int. Cl.[4] ..... F04B 43/06

[52] U.S. Cl. ..... 417/388; 417/63; 417/385; 324/207

[58] Field of Search ..... 417/388, 385, 383, 395, 417/387, 386, 384, 389, 9, 63; 91/275; 92/5 R; 324/207, 226

[56] References Cited

U.S. PATENT DOCUMENTS

| | | | |
|---|---|---|---|
| Re. 29,055 | 11/1976 | Wagner | 417/388 |
| 2,843,050 | 7/1958 | Harper | 91/275 X |
| 3,961,860 | 6/1976 | Ernst | 417/388 X |
| 4,315,523 | 2/1982 | Mahawili | 137/486 |
| 4,355,280 | 10/1982 | Duzich | 324/207 |

FOREIGN PATENT DOCUMENTS

| | | | |
|---|---|---|---|
| 3015797 | 10/1981 | Fed. Rep. of Germany | 91/275 |
| 1135921 | 1/1985 | U.S.S.R. | 417/395 |

*Primary Examiner*—Leonard E. Smith

*Attorney, Agent, or Firm*—Hill, Van Santen, Steadman & Simpson

[57] ABSTRACT

In a diaphragm pump including a first chamber for liquid to be pumped separated from a second chamber for drive fluid by a diaphragm which is driven by a piston alternatively placing the drive fluid under pressure and releasing the pressure from the drive fluid, a signal generator or magnet is located in the diaphragm while a signal detector is located within the pump housing to enable detection of displacement of the diaphragm and, accordingly, the displaced volume of the diaphragm pump. Detection of the displaced volume is used by a regulator to generate a drive signal which, in turn, is used to drive a motor operator connected to a pressure relief valve to control drive fluid pressure and, accordingly, the displaced volume.

23 Claims, 1 Drawing Sheet

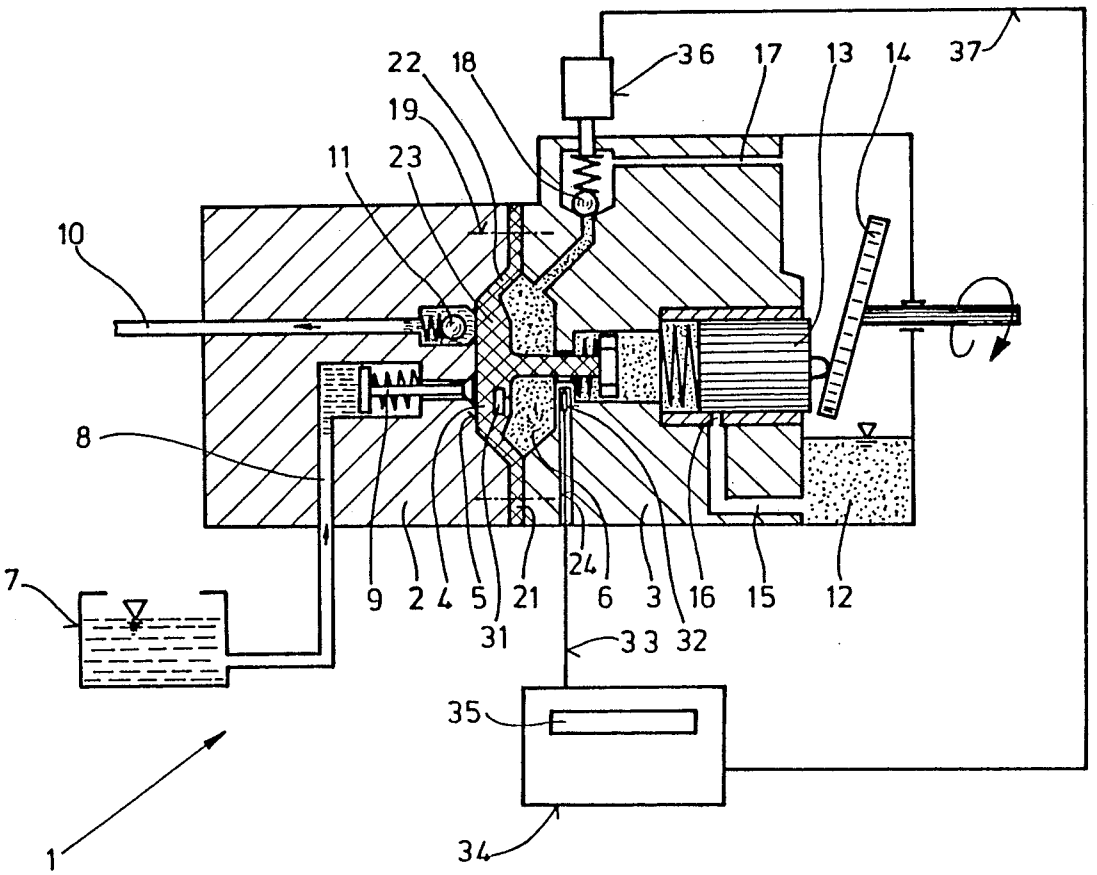
37
14
13
17
36
18
22
19
23
11
10
8
7
1
12
15
16
32
3
33
6
24
21
31
5
4
2
9
35
34

DIAPHRAGM PUMP DEVICE

BACKGROUND OF THE INVENTION

1. Field of the Invention

The invention is directed generally to diaphragm pumps and, more particularly, to a diaphragm pump including a signal generator inserted into a diaphragm therein for measuring displacement of the diaphragm.

2. Discussion of the Related Art

Diaphragm pumps are known. Such pumps generally include a first chamber for liquid or fluid to be pumped, a second chamber for drive fluid, a diaphragm separating the first and second chambers and a drive piston driven in oscillating fashion within the second chamber to place the drive fluid alternatively under pressure and under relaxation. The diaphragm is generally displaced in response to the varying pressure placed upon the drive fluid to thereby effect the necessary pumping action.

The liquid to be pumped is supplied to the first chamber through an intake valve and is removed therefrom via a discharge valve located within a pressure line coupled thereto. A supply chamber for the drive fluid is connected to the second chamber via a return line having a pressure relief valve for letting drive fluid off into the supply chamber given excessive back pressure exerted upon the drive fluid by the pumped fluid. The supply chamber is also connected to the second chamber via a refilling line having a refilling valve for replenishing drive fluid in the second chamber given a removal of drive fluid therefrom.

Diaphragm pumps have generally proven to work well in practice. However, a displaced volume of such pumps is subject to fluctuations. First, air bubbles become entrapped in the drive fluid causing the fluid to become relatively elastic. Second, the displacement of the diaphragm into the first chamber is dependent upon, among other things, the resistance in the pressure line as well as the opening pressure of the pressure relief valve in the drive fluid return line. Therefore, because the pumping action is dependent upon the displaced volume, a constant stream of pumped fluid and, consequently, a high constancy of adjustment to the pump to achieve a steady stream is frequently not establishable. In addition, reproducibility of the stream of pumped fluid that is required cannot be realized.

SUMMARY OF THE INVENTION

An object of the invention is to provide an improved diaphragm pump as discussed above, wherein the displaced volume can be determined and varied with simple means but with extreme precision so that these pumps can be employed as metering pumps having high constancy of adjustment and precisely reproducible streams of pumped fluid. Moreover, structural outlay for accomplishing the foregoing is to be kept low. Nonetheless, a volume displacement measurement is to be possible at every stroke of the diaphragm and such measurement is capable of being used in an adaptation wherein the displaced volume may be held constant by adjusting various valves affecting the amount of the displaced volume.

The foregoing object is achieved in accordance with principles of the invention by including a signal generator in the diaphragm in that area driven by the drive fluid for allowing measurement of a value of the bulging, and accordingly, displacement, of the diaphragm.

A signal detector corresponding to and cooperating with the signal generator is included in housing accepting the diaphragm, the signal detector preferably arranged opposite the signal generator at the same level, and signals of the signal detector being evaluatable and supervisable outside of the diaphragm pump.

In a preferred embodiment, the signal generator is formed by a permanent magnet located in or on the movable portion of the diaphragm. Concomitantly, the signal detector is formed by a magneto-resistive sensor.

In another embodiment, the invention is also applicable to a diaphragm pump including a diaphragm provided with a swelling. The signal generator is merely located in the swelling, preferably on that side of the swelling facing toward the signal detector. The signal detector is located in a portion of housing defining the second chamber within, for example, a bore therein.

Regarding evaluation of the signals generated by the signal generator and the signal detector, the signal detector is preferably connected to a regulator with an output coupled to a control line, the regulator including an adjustable range about a rated displacement value and a digital or analog display of a measured or actual displacement value generated by the signal detector.

Regarding adjustment of the various valves for keeping the displaced volume constant, the pressure relief valve located within the return line is preferably provided with a motor operator or with a final control element, the motor operator or final control element being connected to the regulator via the control line and adjusted by the regulator in response to results of a rated valve to actual or measured value comparison.

In a diaphragm pump constructed in accordance with principles of the invention, it is thus possible with simple means to measure the displacement path of the diaphragm and to thereby ascertain the displaced volume so that the displaced volume can be adjusted to a prescribed rated value in a short time. When a signal generator is located in the diaphragm and a signal detector cooperating therewith is located in the housing, then detected signals can be easily evaluated and monitored and the displaced volume of the diaphragm pump can, accordingly, be known at any time. Furthermore, appropriate measures can be undertaken in order to keep the displacement volume constant or to increase or reduce it.

Since a high reproducibility of the displaced volume and an exact pumped fluid constancy can thus be implemented over a long time span, a diaphragm pump constructed in accordance with the invention is particularly well suited for employment as a controllable metering pump. Different bulges of a diaphragm which are usually unavoidable can be compensated for in a short time with the foregoing simple means.

These and other objects and aspects of the invention will be apparent from the description of the preferred embodiment and attached drawing.

BRIEF DESCRIPTION OF THE DRAWING

The only FIGURE is a schematic of an exemplary diaphragm pump embodying principles of the invention.

DESCRIPTION OF THE PREFERRED EMBODIMENT

Shown in the only FIGURE is a diaphragm pump 1 embodying principles of the invention. The diaphragm pump 1 serves to convey or pump a liquid collected in a supply reservoir 7 to a user or decanting station, not shown. The diaphragm pump 1 includes, essentially, a diaphragm 4 having an edge region 21 clamped between two housing portions or sections 2 and 3 which are tightly clamped together by screws 19. A movable region 22 of the diaphragm 4 divides a chamber formed between the two housing portions 2 and 3 into a first chamber 5 for the liquid to be conveyed or pumped and a second chamber 6 filled with a drive fluid. A piston 13 is provided for driving the diaphragm 4, the piston 13 being activated by a swash plate 14 in oscillating fashion, so that the diaphragm 4 is alternately placed under pressure and relaxation by the drive fluid located in the second chamber 6. In the embodiment shown, a swelling 23 is provided in the movable region 22 of the diaphragm 4. However, the swelling 23 need not be present for the purposes of the invention as will be noted below.

Upon an occurrence of an intake or return stroke of the piston 13, the diaphragm 4 is placed under relaxation and the liquid to be conveyed is drawn, via suction pressure, from the reservoir 7 and into the first chamber 5 via a suction line 8 and via an admission or check valve 9 inserted therein, the admission or check valve 9 allowing the liquid into the first chamber 5 but not to exit therefrom. Upon a pressure or work stroke following the intake or return stroke, the diaphragm 4 is placed under pressure and the liquid drawn into the first chamber 5 is conveyed or pumped under pressure into a pressure line 10 leading to the user via a discharge valve 11. The discharge valve 11 closes off the pressure line 10 from the first chamber 5 upon an intake stroke but which opens the pressure line 10 to the first chamber 5 upon a pressure or work stroke.

The second chamber 6 is connected to a drive fluid supply chamber 12 via a suction line 15 having an admission valve 16 located therein. The second chamber is also connected to the supply chamber 12 via a return line 17 having a pressure relief 18 located therein. During the intake or return stroke of the piston 13, drive fluid is drawn under suction pressure from the supply chamber 12 into the second chamber 6 via the admission valve 16. During the pressure or work stroke of the piston 13, the drive fluid acts upon the diaphragm 4 as a hydraulic rodding. The diaphragm 4 is thus placed into oscillating movement synchronous with the movement of the piston 13.

Displacement of the diaphragm 4 into the first chamber 5, is defined by resistance in the pressure line 10 and by opening pressure of the pressure relief valve 18 through which, depending upon prestressing, drive fluid is discharged out of the second chamber 6 into the supply chamber 12 upon every pressure or work stroke of the piston 13. Displacement of the diaphragm 4 into the first chamber 5 is smaller when there is a constant resistance in the pressure line 10 than when there is a varying resistance in the pressure line 10 as more drive fluid is forced out of the second chamber 6 upon encountering the constant resistance.

A constant resistance in the pressure line 10 means that there are no pressure drops in the pressure line 10. The greater the resistance in the pressure line 10 is, the greater the back pressure in the first chamber 5 is and the greater the drive fluid pressure required to convey a constant stream of pumped liquid is. A greater back pressure of the pumped liquid will preclude the diaphragm 4 from being displaced into the chamber 5 while a greater drive fluid pressure will cause more drive fluid to leave the chamber 6 via the pressure relief valve 18. Thus, constant resistance in the pressure line 10 means greater pressure on opposite sides of the bulge of the diaphragm 4, which effects lesser displacement of the diaphragm 4 into the first chamber 5.

To provide measurement of the displacement of the diaphragm 4 for identification of the corresponding displaced volume of the diaphragm pump 1, a signal generator 31 is located in the diaphragm 4. The signal generator 31 is located within the swelling 23. Additionally, signal detector 32 which cooperates with the signal generator 31 is located in the housing 3, within a bore 24. The signal generator 31 is made, preferably, of a permanent magnet and the signal detector 32 is formed preferably by a magneto-resistive sensor.

Although the signal generator is shown located within the swelling 23, such placement is not critical if the diaphragm 4 does not include the swelling 23. Instead, the signal generator 31 may be located on any suitable surface of the diaphragm 4, or in a diaphragm head portion 23. The only requirement is that the signal detector 32 must be able to detect signals generated by the signal generator 31.

The distance of the signal generator 31 from the signal detector 32 is continuously measured and identified in accordance with known methods for measuring and identifying distances based upon magnetic flux strengths. Because the signal generator or permanent magnet 31 is located within the diaphragm 4, the displacement of the diaphragm 4 is accordingly measured and identified. Because, the displaced volume of the diaphragm pump 1 varies in proportion to the displacement of the diaphragm 4, the displaced volume is also accordingly measured and identified and references to measurement of the displaced volume and of the diaphragm displacement can be made interchangeably.

A regulator 34 is provided for measuring and identifying the displaced volume of the diaphragm pump 4 by monitoring of signals generated by the signal detector 32. The regulator 34 is coupled to the signal detector 32 via a control line 33. Identified measured values of the displaced volume are read out from an analog or digital display 35 coupled to the regulator 34 and included as a portion of the regulator 34.

The regulator 34 is further coupled to a motor operator 36 via a control line 37. The motor operator is allocated to and drives the pressure relief valve 18. By providing the regulator 34 with an adjustable range of displaced volume values about a rated displaced volume value, as is known to do with regulators, the actual measured displaced volume values can be compared to the provided adjustable range of displaced volume values. A deviation of a measured value outside of the provided range of values is used to effect an adjustment in the pressure relief valve 18 to vary the quantity of drive fluid flowing from the second chamber 6 into the supply chamber 12. Thus, given varying resistance in the pressure line 10, the displaced volume of the diaphragm pump 1 can be held constant over a long time span without difficulty. Moreover, the control over the displaced volume can be adapted to other variances which affect changes in the displacement of the diaphragm 4.

While the preferred embodiment of the invention has been set forth above, modifications may become apparent to those skilled in the art which fall within the scope and spirit of the invention. It is intended that such modifications be covered by the attached claims.

We claim:

1. A diaphragm pump comprising:

a diaphragm in a housing separating a first chamber and a second chamber, said first chamber including an intake valve through which a liquid to be pumped is introduced into said first chamber and a discharge valve through which said liquid is pumped in response to pressure exerted thereupon by said diaphragm, said second chamber including an intake valve through which a drive fluid is introduced into said second chamber, a pressure relief valve through which said drive fluid exist from said second chamber and a piston within said second chamber placing said drive fluid under pressure and relaxation, a signal generator made of a permanent magnate included with said diaphragm; and a signal detector made of a magneto-resistive sensor located within said housing for detecting signals generated by said signal generator representative of displacement of said diaphragm within said housing;

a regulator coupled to an output of said signal detector, said regulator including means for comparing a measured displacement value of said diaphragm with an adjustable range of displacement values; and a motor operator connected to said pressure relief valve which is coupled to an output of said regulator, said pressure relief valve being responsive to signals output by said regulator upon effecting a comparison of said measured values to said adjustable range of displacement values.

2. A method of regulating the output of a diaphragm pump having a diaphragm separating a pumped fluid chamber from a drive fluid chamber and a hydraulic drive piston alternatively placing drive fluid in said drive fluid chamber under pressure and under relaxation, comprising the steps of:

measuring displacement of said diaphragm as a function of distance traveled in response to said placement of said drive fluid under pressure and under relaxation;

comparing said measured displacement with a range of displacement valves;

controlling displacement of said diaphragm in response to said comparison.

3. A method as set forth in claim 2 wherein said step of controlling displacement of said diaphragm includes the step of adjusting a pressure relief valve to vary the amount of drive fluid in said drive fluid chamber.

4. A method as set forth in claim 2 wherein said step of measuring displacement of said diaphragm includes the steps of emitting a signal from a portion of said diaphragm which is movable relative to a housing containing said chambers and detecting the strength of said signal relative to said housing.

5. A diaphragm pump comprising:

a diaphragm in a housing separating a first chamber and a second chamber, said first chamber including an intake valve through which a liquid to be pumped is introduced into said first chamber and a discharge valve through which said liquid is pumped in response to pressure exerted thereupon by said diaphragm, said second chamber including an intake valve through which a drive fluid is introduced into said second chamber, a pressure relief valve through which said drive fluid exist from said second chamber and a piston within said second chamber placing said drive fluid under pressure and relaxation;

a signal generator made of a permanent magnate included with said diaphragm; and a signal detector made of a magneto-resistive sensor located within said housing for detecting signals generated by said signal generator representative of displacement of said diaphragm within said housing.

6. A diaphragm pump as set forth in claim 5, wherein said signal detector is located oppositely relative to said signal generator at a height within said housing relative to a bottom of said housing equal to that of said signal generator.

7. A diaphragm pump as set forth in claim 5, wherein said diaphragm further includes a swelling and said signal generator is located within said swelling at a side closer to said signal detector.

8. A diaphragm pump as set forth in claim 5, wherein said signal detector has an output coupled to a regulator.

9. A diaphragm pump comprising:

a diaphragm in a housing separating a first chamber and a second chamber, said first chamber including an intake valve through which a liquid to be pumped is introduced into said first chamber and a discharge valve through which said liquid is pumped in response to pressure exerted thereupon by said diaphragm, said second chamber including an intake valve through which a drive fluid is introduced into said second chamber, a pressure relief valve through which said drive fluid exist from said second chamber and a piston within said second chamber placing said drive fluid under pressure and relaxation, said diaphragm including a signal generator; and a signal detector located within said housing for detecting signals generated by said signal generator representative of displacement of said diaphragm within said housing.

10. A diaphragm pump as set forth in claim 9, wherein said signal detector is located oppositely relative to said signal generator at a height within said housing relative to a bottom of said housing equal to that of said signal generator.

11. A diaphragm pump as set forth in claim 9, further including means for evaluating and monitoring said signals generated by said signal generator outside of said diaphragm pump.

12. A diaphragm pump as set forth in claim 9, wherein said signal generator is located within said diaphragm.

13. A diaphragm pump as set forth in claim 9, wherein said signal generator is located on a surface of said diaphragm.

14. A diaphragm pump as set forth in claim 9, wherein said signal generator comprises a permanent magnet.

15. A diaphragm pump as set forth in claim 9, wherein said diaphragm further includes a swelling and said signal generator is located at a side of said swelling closer to said signal detector.

16. A diaphragm pump as set forth in claim 9, wherein said signal detector is located within a portion of said housing defining said second chamber.

17. A diaphragm pump as set forth in claim 9, wherein said signal detector comprises a magneto-resistive sensor.

18. A diaphragm as set forth in claim 14, wherein said signal detector comprises a magneto-resistive sensor.

19. A diaphragm pump as set forth in claim 9, wherein said signal detector has an output coupled to a regulator.

20. A diaphgram pump as set forth in claim 19, wherein said regulator includes means for comparing a measured displacement value of said diaphragm with an adjustable range of displacement values.

21. A diaphragm pump as set forth in claim 19, wherein said regulator includes a visual display for displaying a measured displacement diaphragm displacement value in at least one of analog and digital format.

22. A diaphragm pump as set forth in claim 20, wherein said pressure relief valve is provided with a motor operator which is coupled to an output of said regulator, said pressure relief valve being responsive to signals output by said regulator upon effecting a comparison of said measured values to said adjustable range of displacement values.

23. A diaphragm device as set forth in claim 22, wherein a displaced volume of said diaphragm pump is held constant through said coupling of said motor operator of said pressure relief valve to said regulator despite fluctuations of pressure in said first chamber.

* * * * *